United States Patent [19]

Mäntymäki

[11] Patent Number: 4,699,656

[45] Date of Patent: Oct. 13, 1987

[54] DEOXIDATION OF MOLTEN COPPER

[75] Inventor: Tarmo K. Mäntymäki, Harjavalta, Finland

[73] Assignee: Outokumpu Oy, Helsinki, Finland

[21] Appl. No.: 935,249

[22] Filed: Nov. 26, 1986

[30] Foreign Application Priority Data

Nov. 28, 1985 [FI] Finland ..... 854723

[51] Int. Cl.[4] ..... C22B 15/00

[52] U.S. Cl. ..... 75/76; 75/72; 75/74; 75/75; 75/93 E

[58] Field of Search ..... 75/76, 93 E, 72, 74, 75/75

[56] References Cited

U.S. PATENT DOCUMENTS 2,989,397 6/1961 Kuzell ..... 75/76

*Primary Examiner*—Peter D. Rosenberg

*Attorney, Agent, or Firm*—Dellett, Smith-Hill and Bedell

[57] ABSTRACT

In order to reduce the amount of oxygen contained in molten copper, a gaseous hydrocarbon such as propane or butane is blasted into an anode furnace, and for creating an efficient mixture between the hydrocarbon and the molten substance, some inert gas such as nitrogen or argon is blasted into the molten mass simultaneously with the hydrocarbon.

13 Claims, No Drawings

DEOXIDATION OF MOLTEN COPPER

The method of the present invention relates to the deoxidation of molten copper mainly in an anode furnace by means of employing as the reducing agent a gaseous hydrocarbon such as propane or butane, as well as an inert gas such as nitrogen.

In order to remove the oxygen dissolved in molten copper, the prior art generally uses gaseous hydrocarbons such as natural gas, propane or butane. While the hydrocarbon reacts with the molten copper, it is broken down into its reduction components, i.e. carbon and hydrogen. The purpose of the reduction is to make the carbon and the hydrogen react with the oxygen which is dissolved in the copper. A well-known fact is that the reduction efficiency generally remains fairly low. That portion of the gas which does not react in the desired fashion with the oxygen contained in the molten substance, burns partly in the gas chamber of the furnace, above the molten section, and partly in the after-furnace installations, and partly remains unburnt and emerges in the exhaust gases as soot. Normally the efficiency is further reduced along the process and may fall down to 20–40%; thus a poor efficiency leads to an unnecessarily high consumption of propane.

The explanation of the poor efficiency lies, at least partly, in the fact that the reducing gas does not interact with the oxygen dissolved in the copper as actively as should be necessary. There have been several attempts to solve the problem, for instance by placing a multitude of nozzles at the bottom of the furnace, or by employing a porous brick or a corresponding structure as the nozzle proper. A porous brick disperses the gas and increases the efficiency to some extent, but this method does not yet bring about a sufficient mixing of the material to be deoxidized—which is essential for an efficient deoxidation.

In earlier practices, oxygen has been removed from molten copper for instance by aid of a natural gas (mainly methane), which has been almost completely reformed into carbon monoxide and hydrogen before feeding to the furnace, as is described in the U.S. Pat. No. 2 989 397. A reformed gas is obtained by burning natural gas partly with air in the presence of a suitable catalyst. The CO content of a reformed gas is about 17%, the $H_2$ content about 30% and $N_2$ content about 47%. As is apparent from the above specification, a separate reformator for the treatment of gases is needed before the anode furnace.

The U.S. Pat. No. 3 604 698 describes the injection of a hydrocarbon such as methane, ethane, propane or butane into the furnace together with water vapour. Hydrocarbon and water vapour are injected through a lance so that in the lance the hydrocarbon is partly reformed into carbon monoxide and hydrogen, due to the effect of water vapour.

Another prior art method for removing oxygen from molten copper is the one described in the U.S. Pat. No. 3 619 177, wherein natural gas is introduced into the molten substance along with air. The oxygen contained in the air oxidizes the natural gas, i.e. reforms it, so that hydrogen and carbon monoxide are created. In addition to this, air is advantageously conducted onto the surface of the molten substance, so that above the bath there is also created an oxidizing atmosphere which reduces the rate of pollution in the exhaust gases.

According to the method introduced in the U.S. Pat. No. 3 767 383, the oxygen contained in molten copper is removed under low pressure, which is below 0,002 atm, by aid of solid carbon. A simultaneous purging of the molten matter with an inert gas, such as nitrogen or argon, reduces the difficulties connected to dissolved nitrogen in low oxygen-contents.

In the experiments carried out we have now realized that by employing nitrogen, in addition to a gaseous hydrocarbon such as propane or butane, in deoxidizing molten copper, the efficiency of the utilized hydrocarbon can be increased, which in turn leads to a reduction in the hydrocarbon consumption. Moreover, soot emissions are reduced owing to a more complete burning of the hydrocarbon. The essential characteristic features of the invention are apparent from the patent claim 1.

Judging by the description of the prior art above, the earlier practice has been to inject air or water vapour together with a gaseous hydrocarbon, but the purpose of these has been to reform the hydrocarbon either before it enters the molten mass or within the molten mass; while using a solid fuel, the nitrogen purging has been connected to dissolved hydrogen, and what is more, the deoxidation has been carried out under a considerably low pressure.

In the method of the present invention, the circulation of molten copper within the anode furnace has been improved by means of a nitrogen addition, so that the products from the decomposition of propane get into a contact as good as possible with the oxygen dissolved in the copper. While injection hydrocarbon only, the decomposition products react only with the oxygen located in the vicinity of the injection point, whereas now the reactions take place throughout the molten substance.

The reduction of the amount of oxygen from the molten copper is carried out in atmospheric conditions within an anode furnace, and in order to achieve an effective mixing, nitrogen is blasted into the molten mass in addition to propane or butane. With respect to thermal economy, nitrogen is a more profitable agent than for instance water vapour, and as regards the technical appliances, it is more easily handled than water vapour.

The introduction of nitrogen and propane (or butane) into the molten substance takes place through the existing tuyeres, so that any special facilities are unnecessary.

Because nitrogen or some other suitable inert gas, such as argon, serves as the mixing agent in the deoxidation, it is advantageous that the amount of the said gas is sufficiently great, for example 40–80% of the total amount of gas. It is also possible to introduce only inert gas into the molten mass, if the oil fed into the heating of the furnace is burned with an air coefficient which is sufficiently low, for instance below 0.8.

Advantageously the reduction can be carried out during the process by means of adjusting the propane-nitrogen ratio as a function of the oxygen content of the molten copper. When the oxygen content of molten copper is high at the beginning of the reduction cycle, the amount of propane in the gas mixture is greater than that of nitrogen, for example 3:1. As the oxygen content is reduced, the amount of the reducing gas with respect to the inert gas is steplessly decreased. The reduction can also be carried out as a so-called stepwise run, in which case it is profitable that at the first stage the propane-nitrogen ratio is about 3:1, but at the second stage the proportion of nitrogen is higher than that of propane, and as a whole the proportion of nitrogen with respect to the total gas amount remains on the aforementioned level.

By means of nitrogen additions, the efficiency of propane has been increased up to the range of 50–80%, but it is obvious that the efficiency can be further increased by optimizing the mixture ratios etc. Simultaneously it is observed that the exhaust gases contain even less carbon then before, which means that the amount of soot in the exhaust gases is decreased. It is likewise observed that the dust occurrences in the furnaces are diminished, and that the utilized nitrogen cools off the exhaust gases to some extent.

The invention is described in more detail with reference to the appended examples.

EXAMPLE 1

Into an industrial-scale anode furnace, containing roughly 200 t of molten copper, there was fed propane and nitrogen in a so-called stepwise run, so that at the first stage the amount of supplied propane and nitrogen was 200 $Nm^3/h$ each. The duration of this first stage was 30 min. At the second stage, duration 100 min, the amount of supplied propane was 100 $Nm^3/h$ and the amount of supplied nitrogen was 300 $Nm^3/h$. The oxygen content of the molten copper was 9500 ppm at the beginning of the deoxidation process, and 5863 ppm at the end. From the given values it can be calculated that the efficiency in using propane was 54.7%.

EXAMPLE 2

The deoxidation was again carried out as a stepwise run. At the first stage, duration 30 min, the amount of supplied propane was 300 $Nm^3/h$ and the amount of supplied nitrogen was 100 $Nm^3/h$. At the second stage the amounts of supplied propane and nitrogen were 200 $Nm^3/h$ each, and the duration of this stage was again 30 min. The oxygen content of molten copper was 7594 ppm at the beginning and 1894 at the end. The efficiency in using propane was 70.2%.

EXAMPLE 3

Into an anode furnace containing molten copper, propane was fed at the rate of 100 $Nm^3/h$ and nitrogen at the rate of 400 $Nm^3/h$ throughout the whole deoxidation cycle. The amount of oil used for heating was 665 kg, and it was burnt with the air coefficient 0.78. The oxygen content of the molten substance was 7624 ppm at the beginning of the deoxidation and 3082 ppm at the end. The efficiency in using propane was 89.4%.

I claim:

1. A method for removing oxygen from molten copper, comprising:

(a) blasting a gaseous hydrocarbon into the molten copper, and (b) simultaneously blasting an inert gas into the molten copper, there being substantially no other gaseous material introduced into the molten copper during steps (a) and (b).

2. A method according to claim 1, wherein the gaseous hydrocarbon is selected from the group consisting of propane and butane.

3. A method according to claim 1, wherein the inert gas is selected from the group consisting of nitrogen and argon.

4. A method according to claim 1, comprising the step of adjusting the ratio of gaseous hydrocarbon and inert gas in dependence upon the concentration of oxygen in the molten copper.

5. A method according to claim 1, wherein at the beginning of the method the proportion of gaseous hydrocarbon is greater than that of inert gas, and the method comprises subsequently adjusting the ratio of gaseous hydrocarbon and inert gas in step-wise fashion so that the proportion of inert gas is greater than that of gaseous hydrocarbon.

6. A method of operating a furnace in which molten copper is prepared, comprising heating the copper by feeding hydrocarbon fuel into the furnace, feeding oxygen into the furnace at a rate which is less than that required to achieve complete oxidation of the hydrocarbon fuel, and subsequently blasting a gaseous material which consists essentially of an inert gas into the molten copper.

7. A method according to claim 1, comprising carrying out steps (a) and (b) by blasting a mixture consisting essentially of a gaseous hydrocarbon and an inert gas into the molten copper.

8. A method according to claim 7, comprising adjusting the ratio of gaseous hydrocarbon and inert gas in the mixture in dependence upon the concentration of oxygen in the molten copper.

9. A method according to claim 7, wherein at the beginning of the method the proportion of gaseous hydrocarbon in the mixture is greater than that of the inert gas, and the method comprises subsequently adjusting the ratio of gaseous hydrocarbon and inert gas in step-wise fashion so that the proportion of inert gas in the mixture becomes greater than that of gaseous hydrocarbon.

10. A method according to claim 9, wherein the ratio of gaseous hydrocarbon to inert gas in the mixture is 3:1 at the beginning of the method.

11. A method according to claim 8, wherein the ratio of gaseous hydrocarbon to inert gas in the mixture is 3:1 at the beginning of the method, and the method comprises reducing the ratio subsequent to the beginning of the method.

12. A method according to claim 11, wherein the step of reducing the ratio of gaseous hydrocarbon to inert gas in the mixture is continued until the proportion of the inert gas in the mixture is at least as great as that of gaseous hydrocarbon.

13. A method according to claim 7, wherein the proportion of inert gas in the mixture is in the range from 40% to 80%.

* * * * *